US011781345B2

(12) United States Patent
Lang

(10) Patent No.: US 11,781,345 B2
(45) Date of Patent: Oct. 10, 2023

(54) DOMESTIC ELECTRICAL APPLIANCE AND DOOR LATCH THEREFOR

(71) Applicant: emz-Hanauer GmbH & Co. KGaA, Nabburg (DE)

(72) Inventor: Markus Lang, Neunburg vorm Wald (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 155 days.

(21) Appl. No.: 17/394,532

(22) Filed: Aug. 5, 2021

(65) Prior Publication Data

US 2022/0064991 A1 Mar. 3, 2022

(30) Foreign Application Priority Data

Aug. 31, 2020 (DE) ..... 10 2020 122 710.8
Sep. 18, 2020 (DE) ..... 10 2020 124 399.5

(51) Int. Cl.
*E05B 47/00* (2006.01)
*D06F 37/42* (2006.01)
(Continued)

(52) U.S. Cl.
CPC ..... *E05B 47/0002* (2013.01); *D06F 37/42* (2013.01); *D06F 39/14* (2013.01); *E05C 3/12* (2013.01); *E05C 3/006* (2013.01)

(58) Field of Classification Search
CPC ..... E05B 47/0002; D06F 37/42; D06F 39/14; E05C 3/12; E05C 3/006
See application file for complete search history.

(56) References Cited

U.S. PATENT DOCUMENTS 8,459,705 B2 * 6/2013 Suh ..... D06F 37/42 292/201
8,651,535 B2 * 2/2014 Oppel ..... E05C 3/24 292/229
(Continued)

FOREIGN PATENT DOCUMENTS

CN 102602595 A 7/2012
CN 105927069 A 9/2016
(Continued)

OTHER PUBLICATIONS

German Office Action in co-pending application DE 102020124399.5, dated May 10, 2021.

*Primary Examiner* — Mark A Williams
(74) *Attorney, Agent, or Firm* — Hayes Soloway PC

(57) ABSTRACT

A door latch for a domestic electrical appliance wherein the door latch comprises a rotary gripper which, on closing of a door, can be transferred from a release position into a gripping position by rotation in a rotational plane, and an electrically controllable locking mechanism having a movably arranged blocking element which, in the gripping position of the rotary gripper, can be fixed in a blocking position in which the blocking element cooperates with the rotary gripper to block the movement of the rotary gripper both from the gripping position into the release position and from the gripping position into a yielding position. The rotary gripper forms a gripping mouth which in the gripping position is oriented to hold captive a closing shackle which, on closing of the door, moves relatively closer to the rotary gripper along a closing path and arranged for a yielding movement into the yielding position.

8 Claims, 10 Drawing Sheets

(51) Int. Cl.

| | |
|---|---|
| ***D06F 39/14*** | (2006.01) |
| ***E05C 3/12*** | (2006.01) |
| *E05C 3/00* | (2006.01) |

(56) References Cited

U.S. PATENT DOCUMENTS

| | | | | |
|---|---|---|---|---|
| 8,661,859 | B2 * | 3/2014 | Choi | D06F 37/42 68/12.26 |
| 10,119,312 | B2 * | 11/2018 | Wang | E05C 19/12 |
| 2005/0194795 | A1 | 9/2005 | Hapke et al. | |
| 2013/0127181 | A1 * | 5/2013 | Rocchitelli | D06F 39/14 292/182 |
| 2015/0225886 | A1 * | 8/2015 | Rocchitelli | E05C 19/00 292/38 |
| 2016/0102481 | A1 | 4/2016 | Weber et al. | |
| 2016/0138809 | A1 * | 5/2016 | Colucci | E05B 15/0046 292/122 |
| 2016/0251881 | A1 | 9/2016 | Dirnberger et al. | |
| 2017/0211221 | A1 * | 7/2017 | Uros | D06F 39/14 |
| 2017/0362766 | A1 * | 12/2017 | Cho | D06F 34/20 |
| 2018/0000312 | A1 | 1/2018 | Dirnberger et al. | |
| 2018/0153370 | A1 * | 6/2018 | Lang | D06F 37/42 |
| 2019/0017216 | A1 * | 1/2019 | Dirnberger | E05B 63/0056 |
| 2019/0040654 | A1 * | 2/2019 | Dirnberger | D06F 39/14 |
| 2019/0048619 | A1 * | 2/2019 | Bicic | D06F 49/003 |

FOREIGN PATENT DOCUMENTS

| | | | |
|---|---|---|---|
| CN | 107550431 | A | 1/2018 |
| DE | 19504797 | C2 | 4/1997 |
| DE | 102016014481 | B3 | 3/2018 |
| DE | 102017006649 | B3 | 9/2018 |

* cited by examiner 26
30
28
40
38
34
46
22
42
44
24
46
32
40
38

26
70
28
38
40
22
46
42
46
24
44
34
32
38
40

DOMESTIC ELECTRICAL APPLIANCE AND DOOR LATCH THEREFOR

BACKGROUND OF THE INVENTION

1. Field of the Invention

The present invention relates to a door latch for a domestic appliance. Particularly, the present invention relates to a domestic electrical appliance equipped with such a door latch.

2. Description of the Prior Art

The door latches under consideration within the scope of the present invention have a rotary gripper which has a gripping mouth which a closing shackle enters on closing of a door of the domestic appliance. The closing shackle thereby first pushes against a front delimiting jaw, as seen in the closing direction, of the gripping mouth. The impact sets the rotary gripper into a rotating motion, during which a rear delimiting jaw, as seen in the closing direction, of the gripping mouth moves behind the closing shackle. When the door is closed, the closing shackle is thus captive in the gripping mouth. For the prior art relating to such door latches, reference may be made, for example, to DE 195 04 797 C2.

In the door latch according to the mentioned DE specification, the rotary gripper, which is referred to therein as a catch, has a bearing pin which engages into an elongate hole formed in a latch housing. The elongate hole extends in the rotational plane of the catch, perpendicular to the direction of the closing path followed by the closing shackle as it enters the gripping mouth of the catch. According to the explanations given in the mentioned DE specification, the elongate hole is intended to permit emergency opening and forced closure.

The door latch according to DE 195 04 797 C2 is designed specifically for a dishwashing machine. Dishwashing machines as are used in private households generally allow the door to be opened during the course of the dishwashing operation. Possible risks due to the escape of hot steam are generally not judged to be sufficiently serious that it would be considered necessary to lock the door of the dishwashing machine during the dishwashing operation and thus make it impossible for a user to open the door during the dishwashing operation. In other types of domestic electrical appliances on the other hand, such as, for example, a washing machine or an electric oven, it is generally assumed to be necessary to be able to lock the door at least in certain operating modes. In a washing machine, for example, it is conventional to lock the door during the washing operation, in particular in the case of washing machines of the front-loader type in which the door is arranged on a front side of the washing machine and there would therefore be a risk of water escaping if the door could be opened by a user during the washing operation. In pyrolytic ovens too, the oven door is conventionally locked at least during pyrolytic operation owing to the considerable amount of heat.

For locking, the catch in DE 195 04 797 C2 could be blocked by a suitable mechanism against rotation from the rotational position shown in FIG. 2 of the DE specification into the position shown in FIG. 1 of the DE specification. However, a finding underlying the invention is that, where there is the possibility of a yielding movement, as is made possible in the DE document by the elongate hole in the housing for the pin of the catch, blocking the rotation of the catch may not always ensure the desired certainty that the user cannot open the door during operation of the domestic appliance. It has been shown that the possibility for a translational yielding movement, as is provided in DE 195 04 797 C2 by the combination of the elongate hole in the housing and the pin that engages therein, presents particular challenges for a locking mechanism by means of which the closed door is to be locked so that it cannot be opened.

SUMMARY OF THE INVENTION

Accordingly, it is one object of embodiments of the present invention to provide a door latch for a domestic electrical appliance which is able to ensure a high degree of certainty against opening of the door during operation of the domestic appliance.

According to one aspect of the present invention, there is provided a door latch for a domestic electrical appliance, the door latch comprising: a rotary gripper arranged to be transferrable, on closing of a door of the domestic appliance and by rotation in a rotational plane, from a release position into a gripping position, the rotary gripper forming a gripping mouth adapted for interaction with a closing shackle which, on closing of the door, comes relatively closer to the rotary gripper along a closing path, wherein the rotary gripper in the gripping position is oriented so as to hold captive in the gripping mouth the closing shackle, and in the release position is oriented so as to release the closing shackle, wherein the rotary gripper in the gripping position is arranged for a yielding movement into a yielding position by translation transversely to the closing path in the rotational plane, in order, in the gripping position, to allow the door to be closed; and an electrically controllable locking mechanism including a movably arranged blocking element, the locking mechanism adapted to fix, when the rotary gripper is in the gripping position, the blocking element in a blocking position in which the blocking element cooperates with the rotary gripper in a manner to block movement of the rotary gripper from the gripping position into the release position and block movement of the rotary gripper from the gripping position into the yielding position.

In the solution according to this aspect, the blocking element performs a dual function: it prevents—when it is in its blocking position—the rotary gripper from rotating back into its release position, and at the same time it blocks the rotary gripper from yielding into the yielding position. It is thus ensured that, in a locked state of the door latch, when the rotary gripper is in its gripping position and the blocking element is fixed in the blocking position, opening of the door can reliably be prevented.

In certain embodiments, the blocking element, in the gripping position of the rotary gripper, cooperates with a blocking surface of the rotary gripper, which blocking surface extends in the rotational plane transversely to the translation of the yielding movement of the rotary gripper.

Certain embodiments provide a pin-elongate hole coupling between the rotary gripper and a carrier component for the rotary gripper. In the gripping position of the rotary gripper, the pin is biased by spring force into a position at one longitudinal end of the elongate hole. During the yielding movement, the pin moves in the elongate hole in the direction towards the other end of the elongate hole. A pulling action, for the purpose of opening the door, on the closing shackle in a situation where the closing shackle, in the gripping position of the rotary gripper, is captive in the gripping mouth thereof and the rotary gripper is blocked by the blocking element generates an additional force component which urges the pin in the elongate hole in the direction towards the one longitudinal end. The generation of such an additional force component (in addition to the biasing brought about by the spring force) can be achieved, for example, by suitable shaping of the delimiting surfaces of the gripping mouth or/and by suitable positioning and geometric shaping of the blocking element and of the portion of the rotary gripper with which the rotary gripper cooperates with the blocking element.

According to a further aspect, there is provided a domestic electrical appliance, comprising: an appliance body having a process chamber formed therein, the process chamber accessible via an access opening; a door for closing the access opening, the door being movably mounted on the appliance body; and a door latch comprising a rotary gripper arranged to be transferrable, on closing of the door and by rotation in a rotational plane, from a release position into a gripping position, the rotary gripper forming a gripping mouth adapted for interaction with a closing shackle which, on closing of the door, comes relatively closer to the rotary gripper along a closing path, wherein the rotary gripper in the gripping position is oriented so as to hold captive in the gripping mouth the closing shackle, and in the release position is oriented so as to release the closing shackle, wherein the rotary gripper in the gripping position is arranged for a yielding movement into a yielding position by translation transversely to the closing path in the rotational plane, in order, in the gripping position, to allow the door to be closed, wherein the door latch comprises a latch assembly mounted to a mounting wall of the domestic appliance, the mounting wall having formed therein a mounting opening and a positioning opening, the positioning opening being separate from the mounting opening. The latch assembly includes a latch housing accommodating the rotary gripper with its rotational plane oriented vertically, and a mouthpiece is formed on the latch housing, the mouthpiece bordering an insertion opening for the closing shackle and projecting through the mounting opening in the mounting wall. The latch housing carries a positioning projection engaging into the positioning opening, wherein the mounting opening and the positioning opening are designed to permit vertical movement play of the latch assembly relative to the mounting wall. According to certain embodiments, this movement play is, for example, at least 0.5 mm or at least 0.8 mm or at least 1.0 mm.

The mentioned movement play can be used to compensate for any mounting tolerances, but also for tolerances due to fatigue phenomena. Such tolerances can have the result that, on closing of the door, the closing shackle does not reach the insertion opening at a specified, defined position but instead deviates vertically from such a specified position. This in turn can lead to inequalities in the opening force to be applied by the user to open the door. The movement play can permit or assist with self-alignment of the latch housing and of the rotary gripper received therein relative to the closing shackle on closing of the door.

In certain embodiments, the mounting wall has formed therein an upper positioning opening and a lower positioning opening, the upper positioning opening being formed vertically above the mounting opening and the lower positioning opening being formed vertically below the mounting opening. The latch housing carries an upper positioning projection disposed vertically above the mouthpiece and a lower positioning projection disposed vertically below the mouth piece, the upper positioning projection engaging into the upper positioning opening and the lower positioning projection engaging into the lower positioning opening. The mounting opening and the upper and lower positioning openings are designed to permit vertical movement play of the latch assembly relative to the mounting wall.

In certain embodiments, the upper and lower positioning openings are designed to prevent horizontal displacement of the latch assembly relative to the mounting wall.

In certain embodiments of a door latch according to the present invention, a locking mechanism may comprise an electromagnetic actuator, through the electrical excitation of which a bolt member, which is coupled for movement with a magnet armature of the actuator, can be transferred between an unlocking position and a locking position. This bolt member can itself form the blocking element; alternatively, the bolt member can be a component separate from the blocking element, which serves to arrest the blocking element in the blocking position against leaving the blocking position. It will be appreciated that the locking mechanism may comprise other types of electrically controllable actuator for actuating a bolt member, for example an electromotive actuator or a bimetallic actuator.

Embodiments of the present invention will be explained in greater detail hereinbelow with reference to the accompanying drawings.

DETAILED DESCRIPTION OF THE INVENTION

Figure 1:
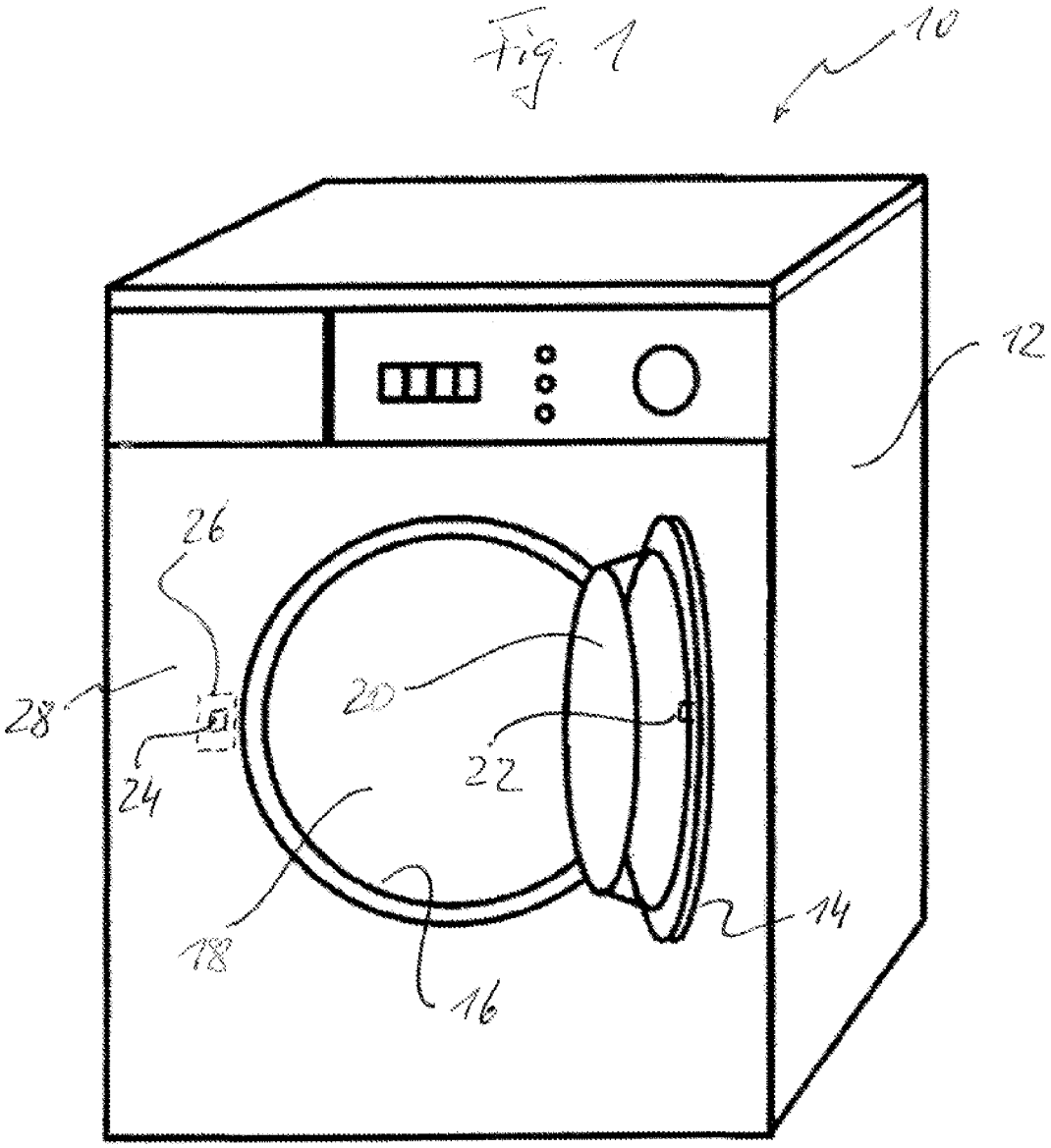
FIG. 1 shows, schematically, a domestic washing machine of the front-loader type according to an exemplary embodiment.

Reference will first be made to FIG. 1. The washing machine shown therein is generally designated 10. It is intended for use in a private household and in the example shown is of the front-loader type, in which there is arranged on a front side of a machine body (appliance body) 12 of the washing machine 10 a door 14 for closing an access opening 16 which provides access to a washing chamber (generally: process chamber) 18 formed in the machine body 12. The door 14 is in the form of a bullseye door and has a transparent bullseye 20 which allows a user to see into the inner chamber 18 through the door 14. The door 14 is mounted on the machine body 12 so as to be pivotable about a vertical pivot axis by means of a hinge, not shown in greater detail. In FIG. 1, the door 14 is in an open position; on closing of the door 14, a closing shackle 22, which in the example shown is mounted on the door 14, enters an insertion opening 24, which is part of a latch assembly 26 indicated by a broken line. The latch assembly 26 serves to hold the door 14 closed by holding the closing shackle 22 captive when the door 14 is closed and thereby securing the door 14 against opening. It is mounted as a structural unit on a front machine wall 28 of the machine body 12.

Figure 2:
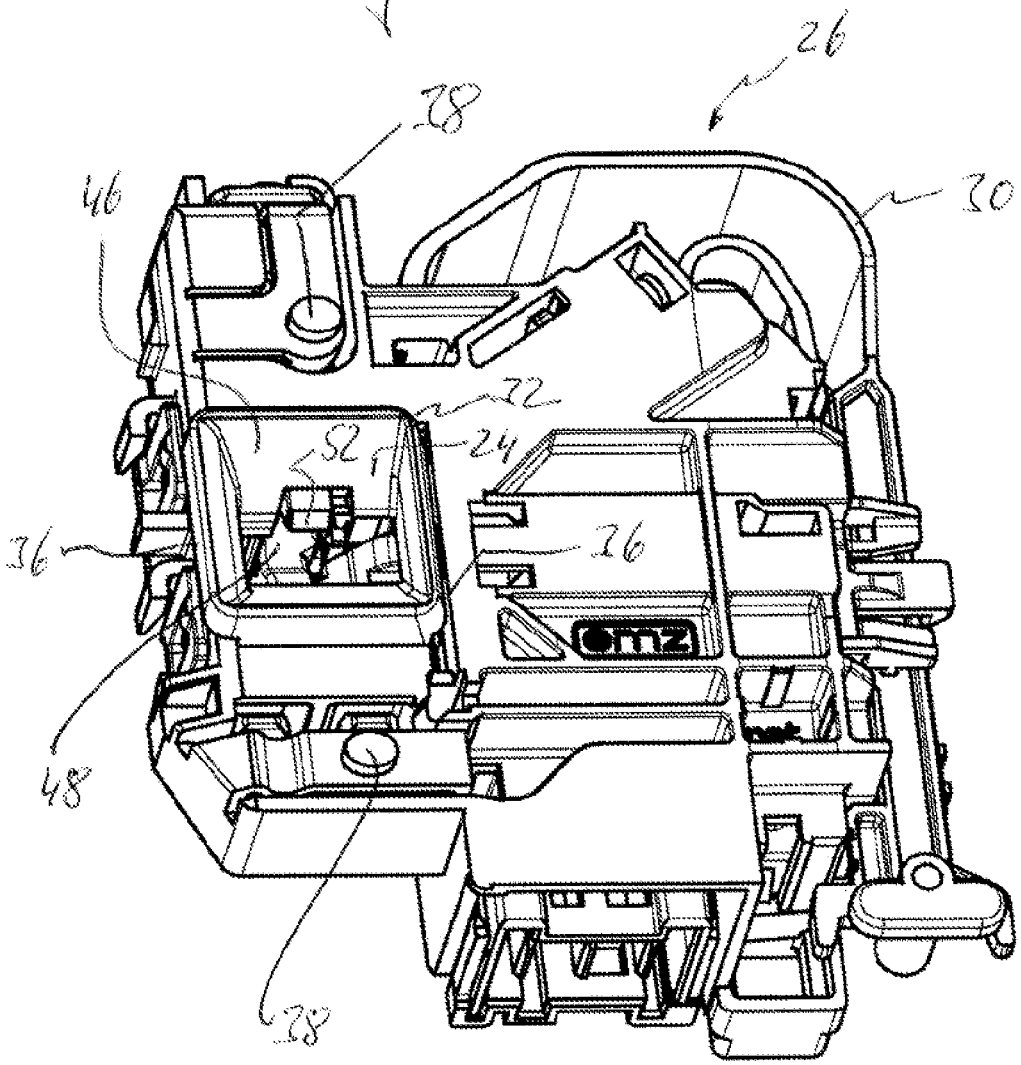
FIG. 2 shows, in perspective, a latch assembly of a door latch according to an exemplary embodiment.

Reference will now additionally be made to FIGS. 2 to 5. FIG. 2 shows, in a perspective view, an exemplary embodiment of the latch assembly 26. The latch assembly 26 comprises a latch housing 30, which can consist of a plurality of separate housing components which can be assembled to form the latch housing 30. The latch housing 30 forms a mouthpiece 32 which borders the insertion opening 24. The mouthpiece 32 is inserted from the rear side of the machine wall 28 through a mounting opening 34 (FIGS. 3, 4 and 5) formed in the machine wall 28. It forms a pair of collar portions 36 which are located opposite one another in the horizontal direction (considered in the installed state of the latch assembly 26) on both sides of the insertion opening 24 and each protrude outwards from the insertion opening 24. In the mounted state, the collar portions 36 protrude over horizontally opposite edge regions of the mounting opening 34, whereby the latch assembly 26 is held on the machine wall 28.

In addition to the mouthpiece 22, the latch housing 30 forms two positioning projections 38 which (again considered in the installed state of the latch assembly 26) are arranged above and below the mouthpiece 32 at a distance therefrom and, in the mounted state of the latch assembly 26, each engage into a positioning opening 40 (FIGS. 3, 4 and 5) in the machine wall 28. In the example shown, the positioning openings 40 are arranged vertically above one another. They serve to secure the latch assembly 26 against twisting and against horizontal displacement relative to the mounting wall 28.

Figure 3:
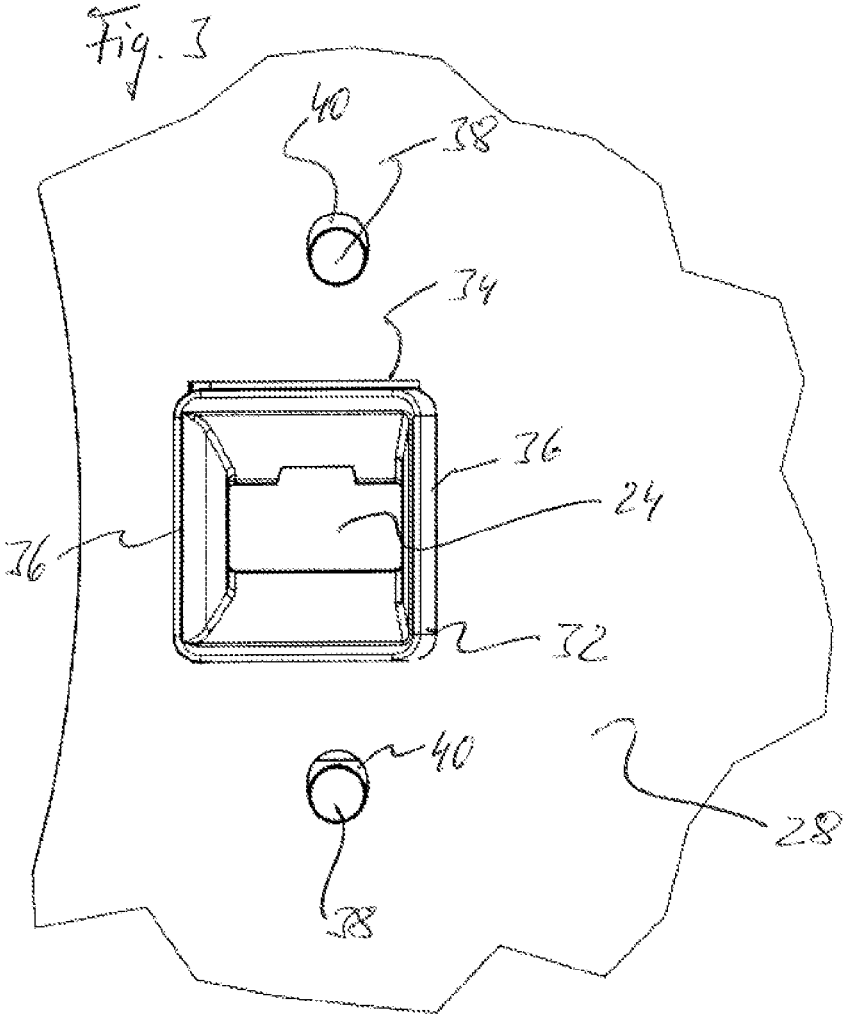
FIG. 3 shows an enlarged detail, from the front, of a portion of a mounting wall on which the latch assembly of FIG. 2 is mounted from the rear side of the mounting wall.
Figure 4:
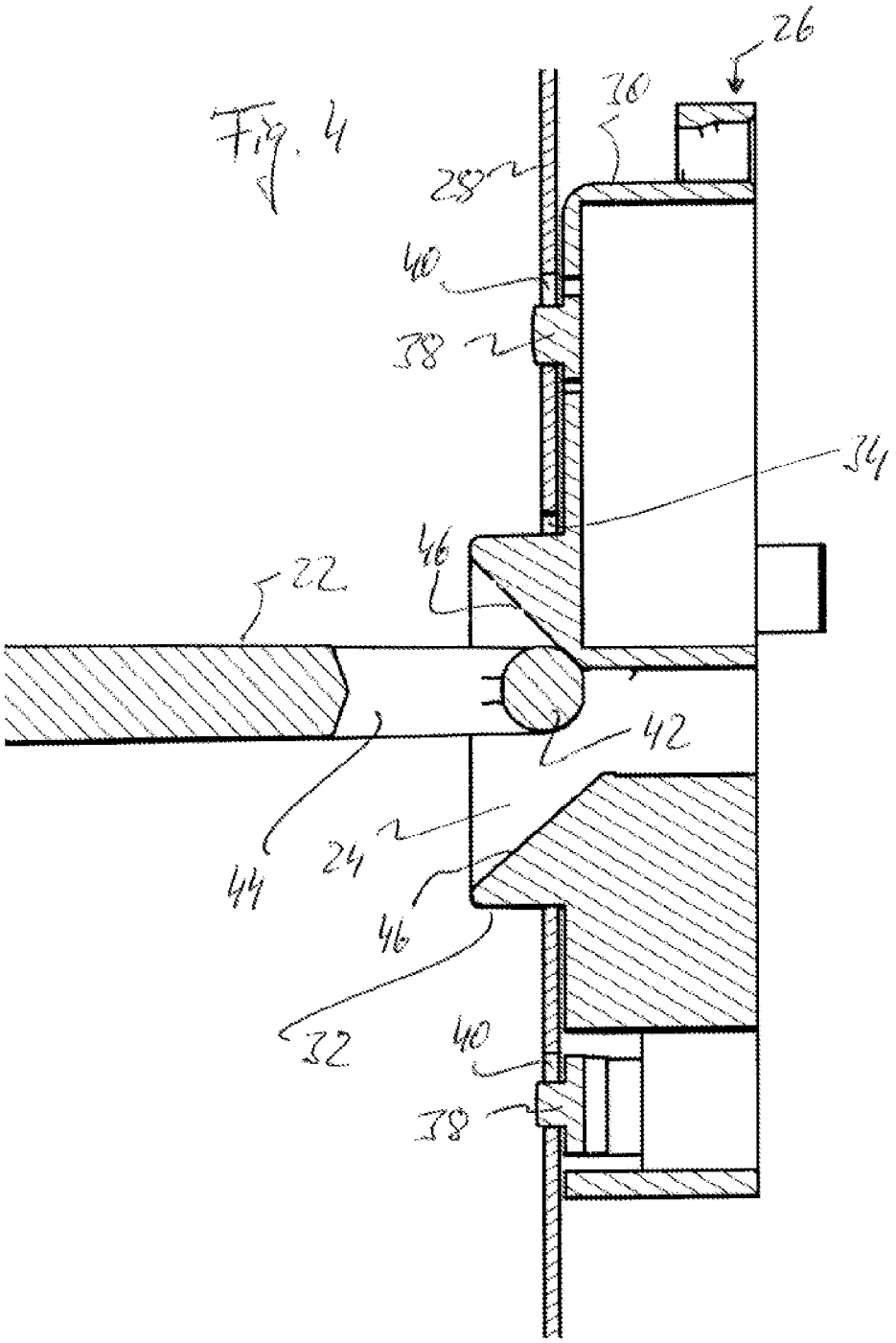
FIGS. 4 and 5 show vertical sections which illustrate a vertical self-alignment of the latch assembly of FIG. 2 on closing of a door.
Figure 5:
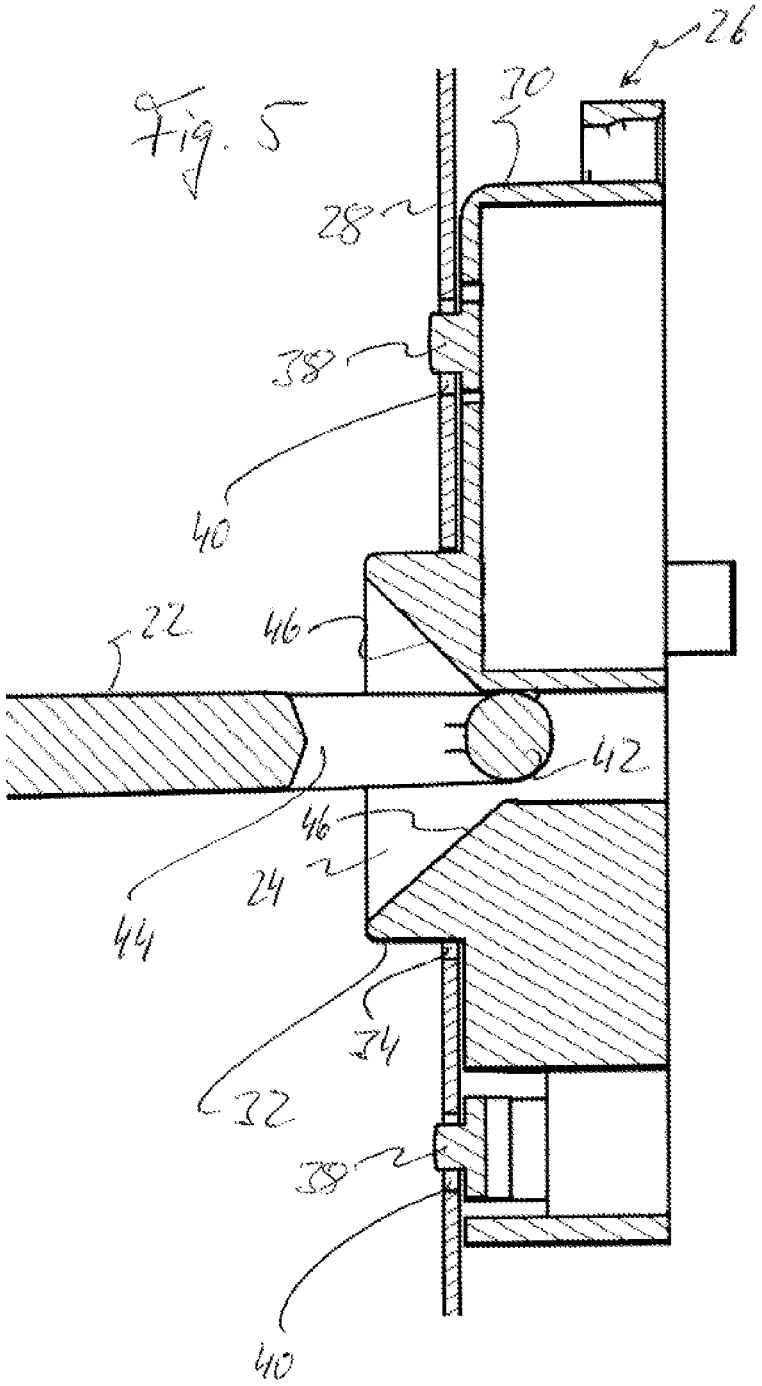

FIGS. 3, 4 and 5 make it clear that the mouthpiece 32 has vertical play in the mounting opening 34 and that, in addition, the positioning projections 38 have vertical play in the positioning openings 40. The extent of the vertical play is, for example, between approximately 0.5 mm and approximately 1.0 mm. Owing to the vertical play that is present, the latch assembly 26 as a whole can perform vertical compensating movements relative to the mounting wall 28 in order thus to permit relative vertical centering of the mouthpiece 32 with the insertion opening 24 relative to the closing shackle 22, which moves closer on closing of the door 14. The closing shackle 22 comprises a horizontally oriented shackle crosspiece 42 (FIGS. 4 and 5), behind which a recess 44 is formed. On closing of the door 14, the shackle crosspiece 42 is captured in a manner which will be explained in greater detail by a gripping member contained in the latch assembly 26. As the door 14 closes, the shackle crosspiece 42 first enters the insertion opening 24. Insertion bevels 46 are formed on the mouthpiece 32 vertically on both sides of the insertion opening 24, which insertion bevels serve as an insertion aid for guiding the shackle crosspiece 42 into a constricted central portion 24-1 of the insertion opening 24. It may be that the door 14, and thus the closing shackle 22, are subject to mounting-induced vertical position tolerances relative to the mounting opening 34. Such position tolerances can occur as a result of fatigue phenomena in the hinge via which the door 14 is held on the machine body 12. The described vertical play of the latch assembly 26 relative to the mounting wall 28 allows such position tolerances to be compensated for. FIG. 4 shows the situation when, owing to vertical misalignment, the shackle crosspiece 42 does not directly enter the constricted central portion 24-1 of the insertion opening 24 as the door 14 closes but instead pushes against one of the insertion bevels 46. As a result of the impact of the shackle crosspiece 42 against the insertion bevel 46 in question, the latch assembly 26 as a whole is displaced in the vertical direction so that the shackle crosspiece 42 is able to slide into the constricted central portion 24-1 of the insertion opening 24, see FIG. 5.

In the exemplary embodiment shown, the positioning openings 40, as can be seen in FIG. 3, are in the form of vertically elongate openings which provide the desired vertical play for the positioning projections 38, which in the example shown have a substantially circular cross section. The positioning openings 40 can be rounded in the region of their vertical longitudinal ends, as is the case in the exemplary embodiment of FIG. 3. Alternatively, the positioning openings 40 can have an approximately quadrangular (e.g. rectangular) opening cross section, wherein the form with the circular cross section that is shown is of course also not intended to be limiting for the positioning projections 38. In the mentioned case of an approximately quadrangular form of the positioning openings 40, it is conceivable, for example, also to produce the positioning projections 38 with an approximately quadrangular cross section. The width and height of the positioning projections 38 are then to be such that the positioning projections 38 have no or at most only negligible play in the positioning openings 40 in the horizontal orientation but the desired play of, for example, approximately 1 mm is present in the vertical orientation.

Figure 6:
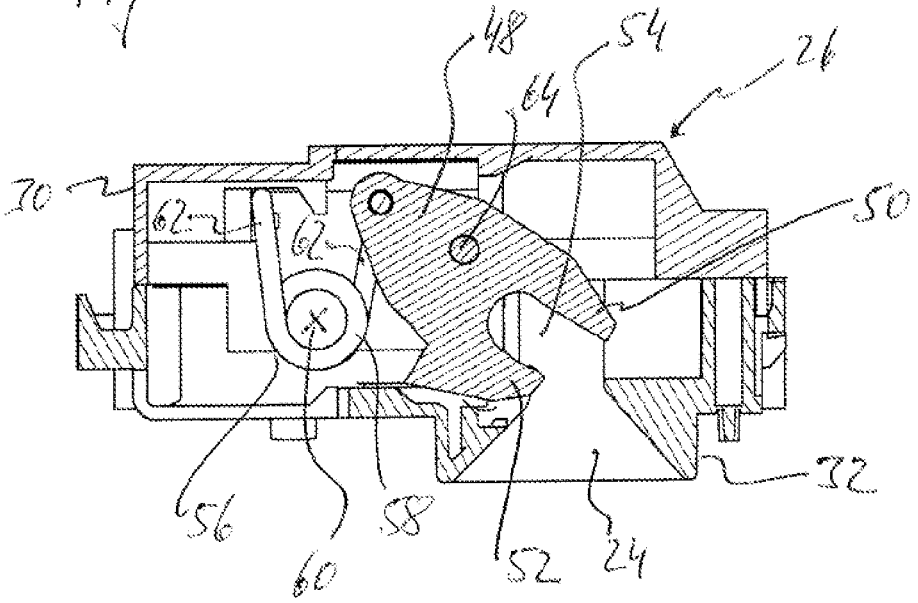
FIG. 6 is a sectional view of the latch assembly of FIG. 2, wherein a gripping member of the latch assembly is shown in a release position.
Figure 7:
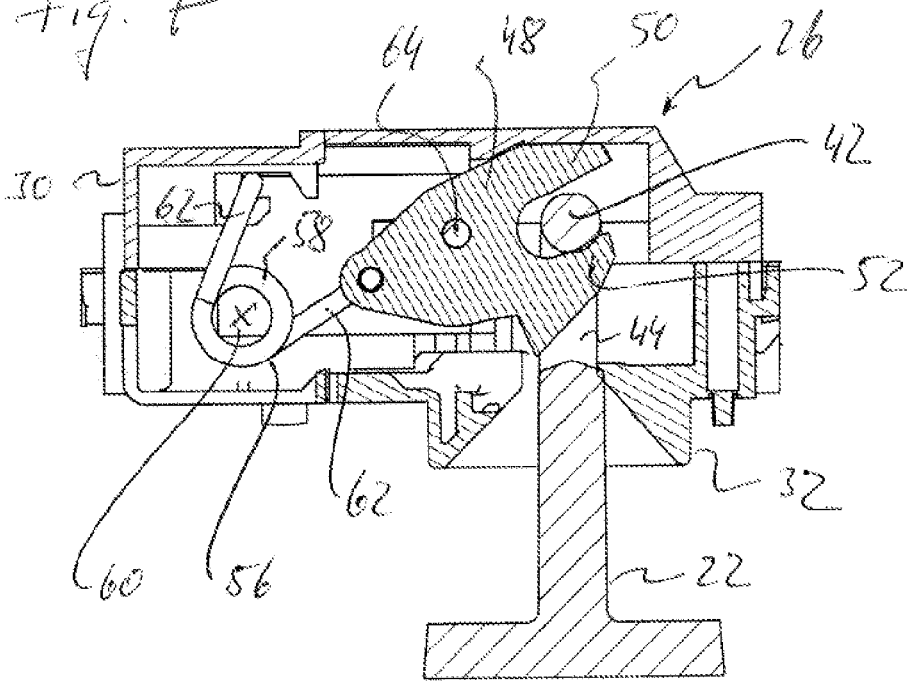
FIG. 7 is a sectional view corresponding to FIG. 6, wherein, however, the gripping member is in a gripping position and a closing shackle is captive in a gripping mouth of the gripping member.

Reference will now additionally be made to FIGS. 6 and 7. The latch assembly 26 comprises a gripping member (rotary gripper) 48, which has a gripping mouth 54 delimited by a control jaw 50 and a gripping jaw 52. FIG. 6 shows the gripping member 48 in a release position, in which the gripping member 48 is ready for the shackle crosspiece 42 to strike the inner side, facing the gripping jaw 54, of the control jaw 50. FIG. 7, on the other hand, shows the gripping member 48 rotated into a gripping position, in which the shackle crosspiece 42 is captive in the gripping mouth 54 and the gripping jaw 52 has entered the recess 44 of the closing shackle 22. A leg spring 56 serves to bias the gripping member 48, in the release position according to FIG. 6, against rotation into the gripping position according to FIG. 7 and equally, in the gripping position according to FIG. 7, to bias it against rotation into the release position according to FIG. 6. When the closing shackle 22 is inserted into the gripping mouth 54 and the gripping member 48 is correspondingly transferred from the release position into the gripping position, the gripping member 48 therefore passes through a dead centre, at which the spring tension of the leg spring 56 is at its greatest. After passing the dead centre (snap point), the gripping member 48 automatically snaps into the respective other position. The leg spring 56 has a spring body 58 which is formed by a helical coil and has a helical axis 60, which in the illustration of FIGS. 6 and 7 extends perpendicularly to the plane of the drawing. The rotation of the gripping member 48 between the release position according to FIG. 6 and the gripping position according to FIG. 7 takes place in a plane (rotational plane) which extends perpendicularly to the helical axis 60 of the leg spring 56. In the exemplary embodiment shown, the spring legs, denoted 62, of the leg spring 56 are coupled with the latch housing 30, or the gripping member 48.

Figure 8:
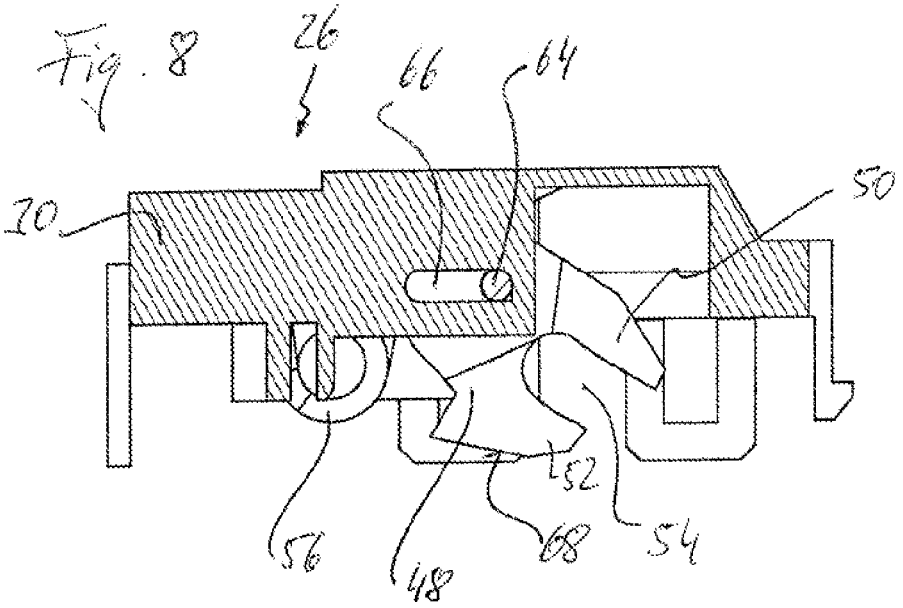
FIG. 8 is a view illustrating the mounting of the gripping body of FIGS. 6 and 7 with movement play relative to a latch housing of the latch assembly.

As can be seen in FIG. 8, the gripping member 48 is mounted by means of an axial shaft 64 in a bearing slot 66 of the latch housing 30 so as to be displaceable in a direction which extends substantially parallel to the plane in which the gripping member 48 is displaceable between the release position and the gripping position and which extends transversely, in particular substantially perpendicularly, to a direction in which the closing shackle 22 enters the insertion opening 24 on closing of the door 14. The axial shaft 64 protrudes, when considering FIG. 8, in front of and behind the gripping member 48 on both sides thereof; a bearing slot 66 is correspondingly provided in the latch housing 30 in association with each of the shaft portions of the axial shaft 64 that protrude from the gripping member 48. The axial shaft 64 is fixedly connected to the gripping member 48; for example, the gripping member 48 and the axial shaft 64 can be produced as a one-piece, cohesive component in an injection moulding operation.

Figure 9:
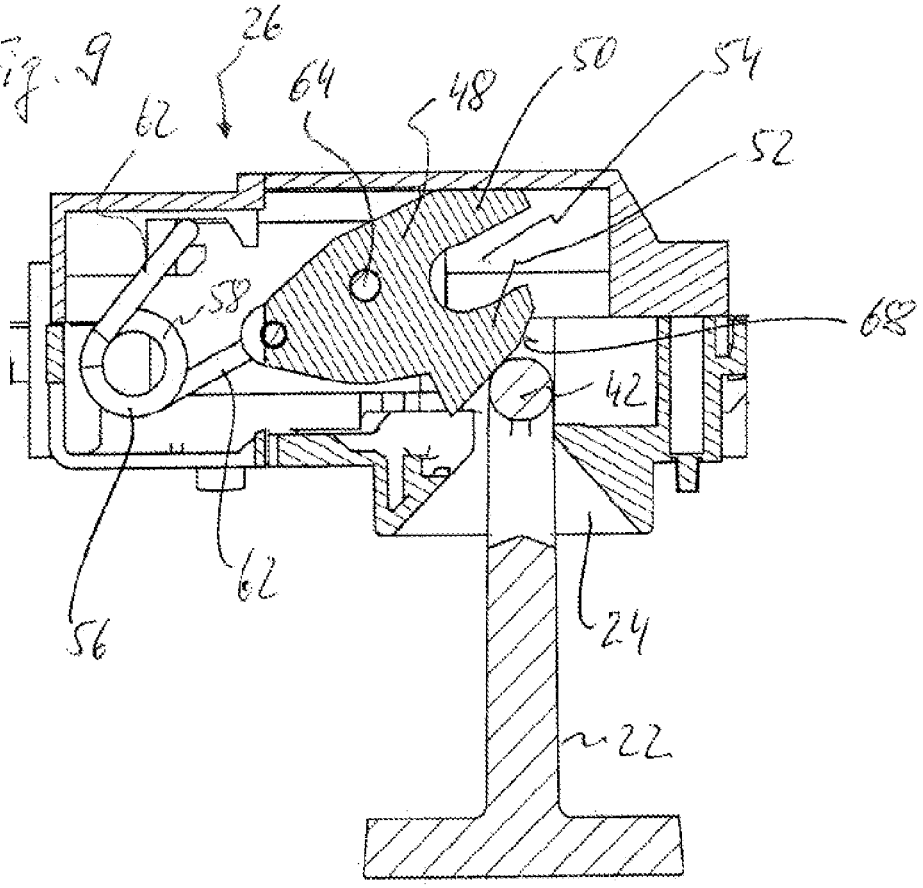
FIG. 9 shows a yielding movement of the gripping body of FIGS. 6 and 7 in the case of a self-healing process of the door latch.

Via the engagement of the axial shaft 64 into the bearing slots 66, the gripping member 48 is supported on the latch housing 30 not only so as to be rotatable relative to the latch housing 30 between the release position and the gripping position but also so as to be displaceable relative to the latch housing 30 in the gripping position in the longitudinal direction of the bearing slots 66. This displaceability can be used for a self-healing function of the latch assembly 26. As is shown in FIG. 9, it may be that the gripping member 48 moves into its gripping position without the closing shackle 22 at the same time being captured by its shackle crosspiece 42 in the gripping mouth 54. This may occur, for example, if, after the door 14 has successfully been closed, it is opened again and the shackle crosspiece 42 is pulled out of the gripping mouth 54 while at the same time rotating the gripping member 48.

At the point when the gripping jaw 52 has moved out of the movement path of the shackle crosspiece 42, which is moving away, and the shackle crosspiece 42 is able to move past the gripping jaw 52, the dead centre of the leg spring 56 should be passed; the gripping member 48 should then automatically snap into its release position according to FIG. 6. It has been shown, however, that situations can occur in which the shackle crosspiece 42 leaves the gripping jaw 54 and the gripping member 48 nevertheless snaps back into its gripping position. The result of such a situation is shown in FIG. 9. Although the door 14 can now be opened fully, the gripping member 48 nevertheless remains in its gripping position. The mentioned self-healing function of the latch assembly 26 allows the closing shackle 22 to be brought back into gripping engagement with the gripping member 48 simply by closing the door 14.

To this end, the gripping jaw 52 forms on its jaw back, which is remote from the gripping mouth 54, a control surface 68 which, in the gripping position of the gripping member 48, is oriented obliquely relative to the direction of the closing path taken by the closing shackle 22 on closing of the door 14, such that, when the shackle crosspiece 42 comes into contact with the control surface 68, the gripping member 48 is pushed to the side and moves out of the way of the approaching closing shackle 22. The bearing slots 66 in the latch housing 30 permit this lateral compensating movement of the gripping member 48, which is to be carried out against the action of the leg spring 56. Therefore, owing to the biasing action of the leg spring 56, the gripping member 48 is urged back into its gripping position according to FIG. 7 after the shackle crosspiece 42 has moved past the gripping jaw 52 and into the gripping mouth 54. The shackle crosspiece 42 can thus be captured properly in the gripping mouth 54.

Figure 10:
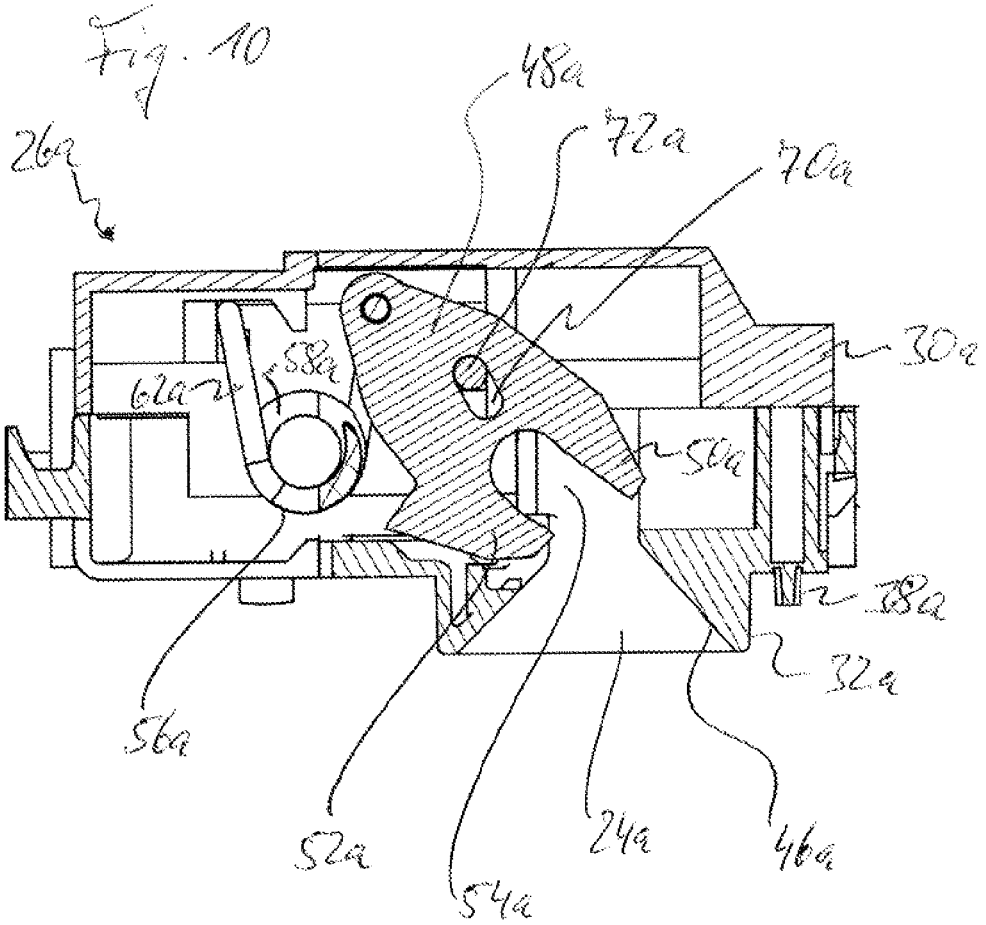
FIG. 10 shows a variant for achieving mounting of the gripping body with movement play relative to the latch housing.

In the variant according to FIG. 10, where elements that are the same or have the same action are provided with the same reference numerals as in FIGS. 1 to 9 but with the addition of a lowercase letter, the play of the gripping member **48*a* is achieved by a slot 70*a* formed in the gripping member 48*a*, through which slot there passes a bearing pin 72*a* held on the latch housing 30*a*. The gripping member 48*a*, as it is displaced from the release position into the gripping position and back, rotates about the bearing pin 72*a*, which is arranged stationarily relative to the latch housing 30*a***.

Figure 11:
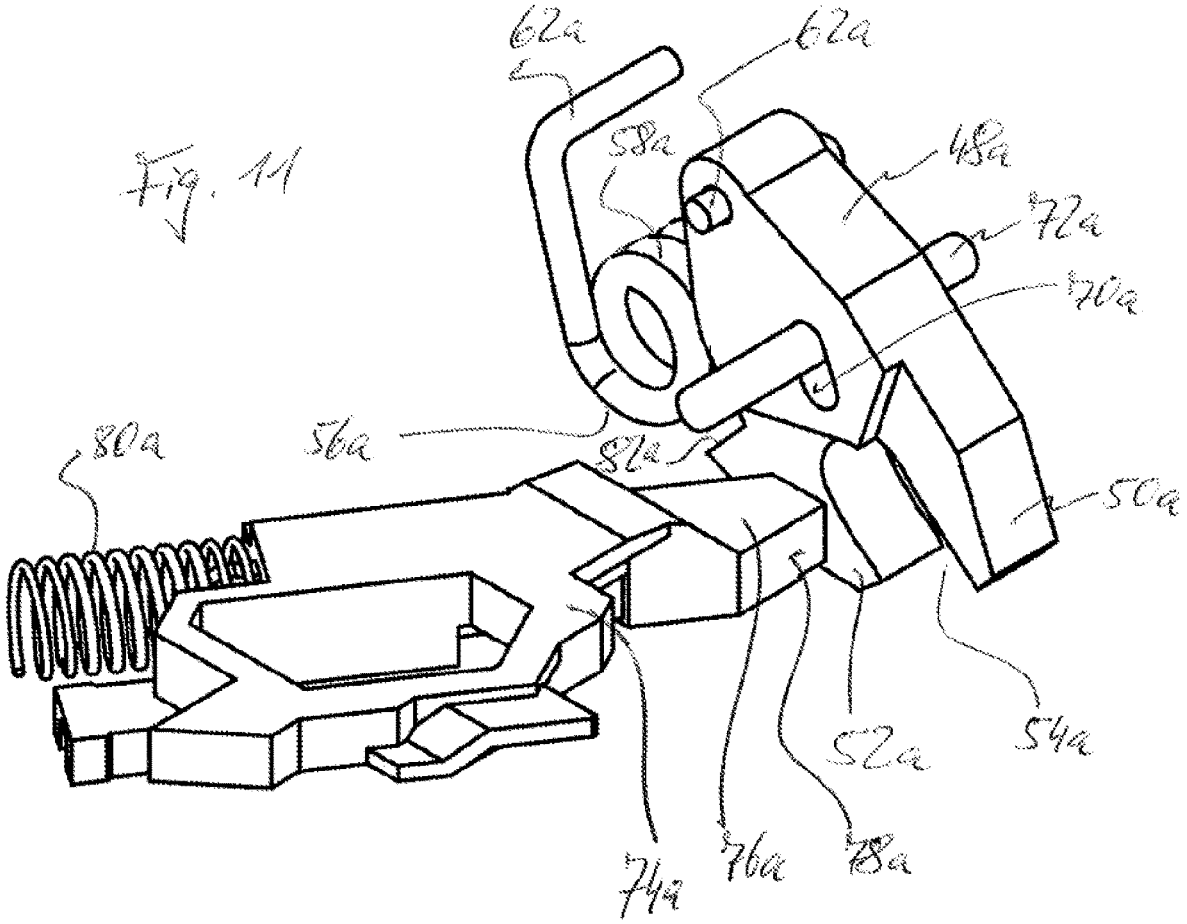
FIG. 11 shows, in perspective, the gripping body of the variant according to FIG. 10 together with a blocking element as part of a locking mechanism for locking the gripping member in its gripping position.
Figure 12:
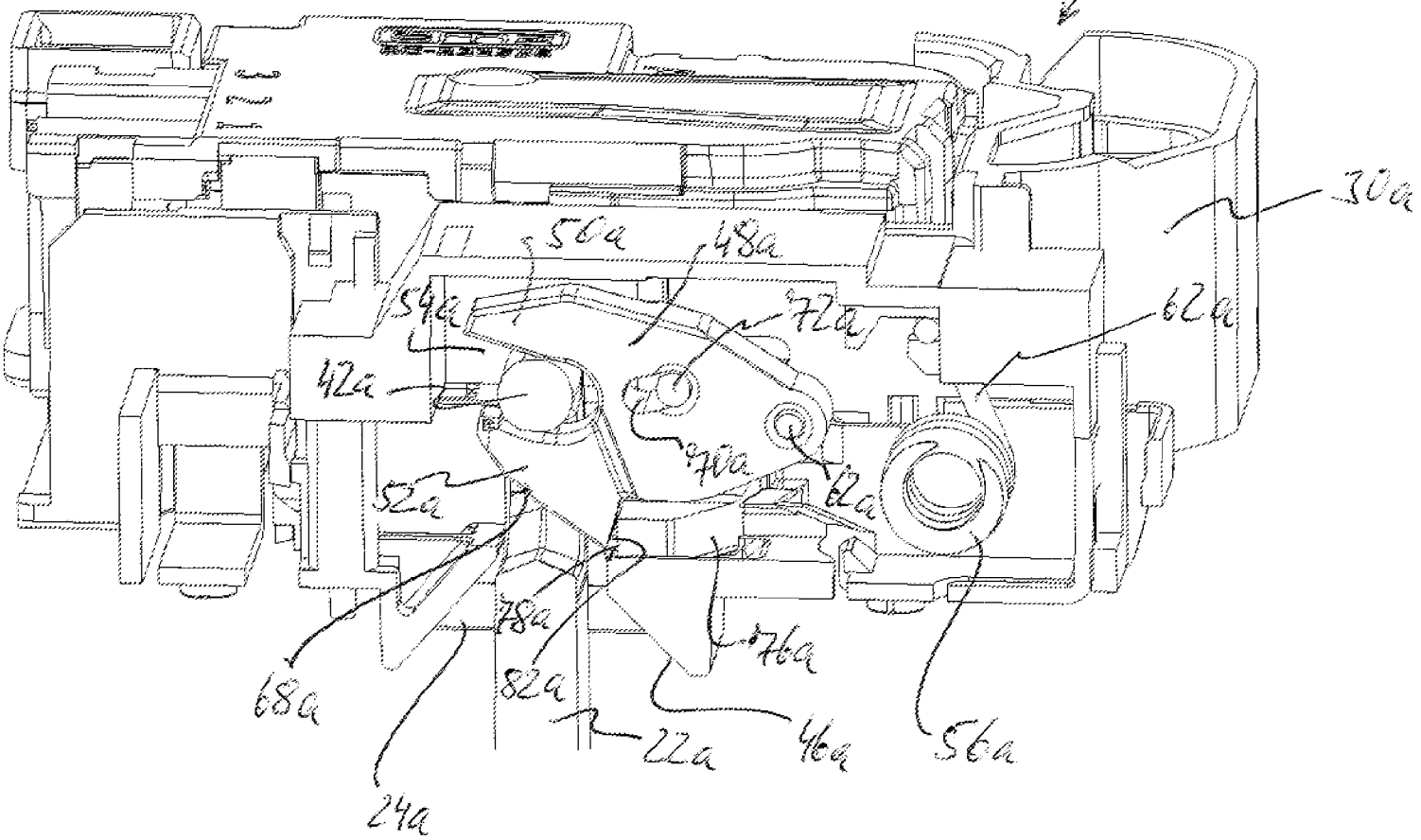
FIG. 12 is a cutaway view of a door latch of the variant according to FIG. 10 with the door closed, wherein the blocking element of FIG. 11 is in a blocking position.

Reference will now additionally be made to FIGS. 11 and 12, which show further illustrations of the latch assembly **26*a* according to the variant of FIG. 10. FIGS. 11 and 12 show components of a locking mechanism by means of which the gripping member 48*a* in its gripping position can be blocked against rotation into the release position and against translation into the yielding position. For reasons of clarity, said components are not shown in FIG. 10 but are to be assumed to be present in that figure too. The locking mechanism comprises a blocking element 74*a* having a blocking lug 76*a* on which a blocking surface 78*a* is formed. The blocking element 74*a* is acted upon by a biasing spring 80*a*, which in the example shown is formed by a compression spring and which biases the blocking element 74*a* towards the gripping member 48*a*** in a direction perpendicular to the rotational plane of the gripping member.

In the situation shown in FIG. 11, the gripping member **48*a* is in its release position. In this situation, the blocking element 74*a* lies with an end face of the blocking lug 76*a* against a side flank of the gripping jaw 52*a*. When the gripping member 48*a* is transferred from the release position into the gripping position, a blocking edge 82*a* formed on the gripping member 48*a* moves past the blocking lug 76*a*. This frees the path for the blocking lug 76*a* to move, driven by the spring force of the biasing spring 80*a*, in front of the blocking edge 82*a* into a blocking position. The result is shown in FIG. 12**.

In the blocking position, the blocking element **74*a* can be barred from moving back into the unlocking position according to FIG. 11. For this purpose, an electrically controllable actuator (e.g. electromagnetic actuator), not shown in greater detail in the figures, can move a bolt member, likewise not shown in greater detail, into the movement path of the blocking element 74*a*. The blocking element 74*a* is then no longer able to move back out of the blocking position according to FIG. 12 into the unlocking position according to FIG. 11. Without such barring of the blocking element 74*a*, the gripping member 48*a* is able to push the blocking element 74*a* out of the rotational path of the gripping member 48*a* when, as a result of a user pulling on the door, there is exerted on the gripping member 48*a* a rotational force which attempts to rotate the gripping member 48*a* from the gripping position into the release position. For this purpose, the blocking element 74*a* can be supported on the latch housing 30*a* via a pair of sloping surfaces, that is to say via a pair of mutually adjacent sloping surfaces, of which one is formed on the blocking element and the other is formed on the latch housing. The sloping surfaces permit a wedge effect, by means of which an angular momentum acting on the gripping member 48***a* can be converted into a backward movement of the blocking element 74*a*. Pressure of the blocking edge 82*a* on the blocking lug 76*a* can therefore—provided that the blocking element 74*a* is not barred—urge the blocking element back into its unlocking position according to FIG. 11; the gripping jaw 52*a* can again move in front of the end face of the blocking lug 76*a*.

It will be seen in FIG. 12 that the blocking surface 78*a* of the blocking element 74*a* extends substantially parallel to the direction of the closing path of the closing shackle 22*a* when it enters the insertion opening 24*a*. In other words, the blocking surface 78*a* extends transversely to the direction of the yielding translation of the gripping member 48*a* during self-healing. At the same time, the blocking surface 78*a* is so oriented that it is opposed to a translation of the gripping member 48*a* from the gripping position into the yielding position required for self-healing. As a result, in the locked state of the latch assembly 26*a*, when the blocking element 74*a* is arrested in its blocking position according to FIG. 12 and is barred from moving back into the unlocking position, not only a rotation of the gripping member 48*a* from the gripping position into the release position, but also a yielding movement of the gripping member 48*a* in the elongate hole 70*a* is effectively prevented. This ensures that, during the washing operation of the washing machine, the door is reliably secured against opening.

By suitably configuring the gripping jaw 52*a* (in particular suitably shaping the front side of the gripping jaw 52*a* that faces the gripping mouth 54*a*) or/and by suitably locating the blocking edge 82*a* of the gripping member 48*a* along the circumference of the gripping member 48*a*, it can be achieved that, when the user attempts to open the closed and locked door, a force is generated on the gripping member 48*a* which urges it even more strongly against the bearing pin 72*a* (in a direction contrary to the direction of the yielding movement of the gripping member 48*a* during self-healing). Such an additional force component can effectively prevent undesirable yielding movements of the gripping member 48*a* in the locked state of the latch assembly 26*a* and boosts a spring force which is in any case exerted by the leg spring 56*a* on the gripping member 48*a* and which opposes the self-healing yielding movement of the gripping member 48*a*.

A locking mechanism as has been described hereinbefore with reference to the exemplary embodiment of FIGS. 10 to 12 can of course also be provided in the exemplary embodiment of FIGS. 2 to 9.

Instead of being used in a washing machine, the described exemplary embodiments of a door latch according to the invention can also be used, for example, in a pyrolytic oven.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for a domestic electrical appliance, the door latch comprising:

a rotary gripper rotatable between a release position and a gripping position, the rotary gripper comprising a gripping mouth engageable with a closing shackle, wherein the closing shackle is movable along a closing path and the rotary gripper is positioned along the closing path, wherein the rotary gripper in the gripping position hold the closing shackle in a captive position with the gripping mouth, and in the release position is disengaged with the closing shackle, wherein the rotary gripper in the gripping position is arranged for a yielding movement along a yielding path, wherein the yielding path is transverse to the closing path and whereby yielding movement retracts the rotary gripper from the closing path upon receiving force from contact with the closing shackle, with the gripper in a yielding position and unblocking the closing path of a door of the domestic appliance; and an electrically controllable locking mechanism including a movably arranged blocking element, the locking mechanism adapted to fix, when the rotary gripper is in the gripping position, the blocking element in a blocking position in which the blocking element cooperates with the rotary gripper in a manner to block movement of the rotary gripper from the gripping position into the release position and block movement of the rotary gripper from the gripping position into the yielding position.

2. The door latch of claim 1, wherein the blocking element includes a blocking surface adapted for engagement with the rotary gripper in the gripping position thereof, the blocking surface extending in the rotational plane of the rotary gripper transversely to the yielding path.

3. The door latch of claim 1, further comprising a gripper support member, the rotary gripper supported on the gripper support member by a pin-elongate hole coupling, the pin-elongate hole coupling including a pin formed on one of the rotary gripper and the gripper support member and an elongate hole formed on the other of the rotary gripper and the gripper support member, the elongate hole having opposite longitudinal hole ends, wherein in the gripping position of the rotary gripper, the pin is biased by spring force into a position at one of the longitudinal hole ends, wherein the pin, during the yielding movement, moves in the elongate hole in the direction towards the other of the longitudinal hole ends, wherein a pulling action on the closing shackle for the purpose of opening the door, when the closing shackle, in the gripping position of the rotary gripper, is captive in the gripping mouth thereof and the rotary gripper is blocked by the blocking element, causes generation of an additional force component effective to urge the pin in the elongate hole in the direction towards the one of the longitudinal hole ends.

4. A domestic electrical appliance, comprising:

an appliance body having a process chamber formed therein, the process chamber accessible via an access opening;

a door for closing the access opening, the door being movably mounted on the appliance body; and a door latch comprising a rotary gripper rotatable between a release position and a gripping position, the rotary gripper comprising a gripping mouth engageable with a closing shackle, the closing shackle movable along a closing path and the rotary gripper is positioned along the closing path, wherein the rotary gripper in the gripping position is oriented so as to hold captive in the gripping mouth the closing shackle, and in the release position is oriented so as to release the closing shackle, wherein the rotary gripper in the gripping position is arranged for a yielding movement wherein the yielding movement retracts the rotary gripper from the closing path upon receiving force from a contact with the closing shackle, ending with the gripper in a yielding position and unblocking the closing path of the door of the domestic appliance, wherein the door latch comprises a latch assembly mounted to a mounting wall of the domestic appliance, the mounting wall having formed therein a mounting opening and a positioning opening, the positioning opening being separate from the mounting opening, wherein the latch assembly includes a latch housing accommodating the rotary gripper with its a vertically oriented rotational plane, a mouthpiece formed on the latch housing, the mouthpiece bordering an insertion opening for the closing shackle and projecting through the mounting opening in the mounting wall, wherein the latch housing carries a positioning projection engaging into the positioning opening, wherein the mounting opening and the positioning opening permit vertical movement play of the latch assembly relative to the mounting wall.

5. The domestic electrical appliance of claim 4, wherein the mounting opening and the positioning opening are designed to permit vertical movement play of at least 0.5 mm or at least 0.8 mm or at least 1.0 mm of the latch assembly relative to the mounting wall.

6. The domestic electrical appliance of claim 4, wherein the mounting wall has formed therein an upper positioning opening and a lower positioning opening, the upper positioning opening being formed vertically above the mounting opening and the lower positioning opening being formed vertically below the mounting opening, wherein the latch housing carries an upper positioning projection disposed vertically above the mouthpiece and a lower positioning projection disposed vertically below the mouth piece, the upper positioning projection engaing into the upper positioning opening and the lower positioning projection engaing into the lower positioning opening, wherein the mounting opening and the upper and lower positioning openings are designed to permit vertical movement play of the latch assembly relative to the mounting wall.

7. The domestic electrical appliance of claim 6, wherein the upper and lower positioning openings are designed to prevent horizontal displacement of the latch assembly relative to the mounting wall.

8. The domestic electrical appliance of claim 4, wherein the appliance is a washing machine.

* * * * *